US007828042B2

(12) United States Patent
Li et al.

(10) Patent No.: US 7,828,042 B2
(45) Date of Patent: Nov. 9, 2010

(54) HOT RUNNER MAGNESIUM CASTING SYSTEM AND APPARATUS

(75) Inventors: Naiyi Li, Ann Arbor, MI (US); Ronald Cooper, Canton, MI (US); Jim deVries, Canton, MI (US); Nanda Gopal, Troy, MI (US); Christopher Lee, Beverly, MA (US); Tom Scholten, Holland, MI (US); Raymond Silva, Maumee, OH (US)

(73) Assignee: Ford Global Technologies, LLC, Dearborn, MI (US)

( * ) Notice: Subject to any disclaimer, the term of this patent is extended or adjusted under 35 U.S.C. 154(b) by 949 days.

(21) Appl. No.: 11/560,416

(22) Filed: Nov. 16, 2006

(65) Prior Publication Data

US 2008/0115907 A1 May 22, 2008

(51) Int. Cl.
*B22D 17/04* (2006.01)

(52) U.S. Cl. ..... 164/316; 164/113; 164/312; 164/317

(58) Field of Classification Search ..... 164/113, 164/312, 316, 317, 133, 135, 244
See application file for complete search history.

(56) References Cited

U.S. PATENT DOCUMENTS

| | | | | |
|---|---|---|---|---|
| 1,964,324 | A | 6/1934 | Korsmo | |
| 3,270,383 | A | 9/1966 | Hall et al. | |
| 3,652,073 | A | 3/1972 | Lewis | |
| 4,408,651 | A | 10/1983 | Smedley et al. | |
| 4,595,044 | A * | 6/1986 | Caugherty et al. | 164/337 |
| 4,690,198 | A | 9/1987 | Hardey et al. | |
| 5,244,033 | A * | 9/1993 | Ueno | 164/312 |
| 5,299,623 | A | 4/1994 | Yaffe et al. | |
| 6,305,921 | B1 | 10/2001 | Grams et al. | |
| 6,405,784 | B2 | 6/2002 | Takizawa et al. | |
| 6,405,785 | B1 | 6/2002 | Gellert et al. | |
| 6,505,674 | B1 * | 1/2003 | Sample et al. | 164/113 |
| 6,634,412 | B1 | 10/2003 | Murray et al. | |
| 6,830,094 | B2 * | 12/2004 | Fink | 164/113 |
| 6,945,308 | B1 * | 9/2005 | Jones | 164/113 |
| 6,945,310 | B2 * | 9/2005 | Hirai et al. | 164/312 |
| 2002/0121355 | A1 | 9/2002 | Bigler et al. | |

* cited by examiner

*Primary Examiner*—Jessica L Ward
*Assistant Examiner*—Kevin E Yoon
(74) *Attorney, Agent, or Firm*—Shook, Hardy & Bacon L.L.P.

(57) ABSTRACT

A method and apparatus for the casting of metal components is disclosed. The apparatus includes a gooseneck for drawing molten metal from a crucible of hot metal and for forcing the drawn molten metal through the system, a hot runner assembly having a hot runner tip positioned adjacent the mold cavity, and a machine nozzle inserted between the gooseneck and the hot runner assembly. The gooseneck is fitted with a one-way check valve to allow for molten metal to be drawn into the plunger but to stop its passage out of the gooseneck when the metal is forced through the system into the die. A thermal valve is formed within the hot runner tip to provide a metal blockage from the molten metal which prevents the back-flow of molten metal back into the hot runner assembly. Both temperature and flow rate are carefully monitored and controlled.

24 Claims, 9 Drawing Sheets

HOT RUNNER MAGNESIUM CASTING SYSTEM AND APPARATUS

GOVERNMENT CONTRACT INFORMATION

This invention was made with United States Government support awarded by the following program, agency and contract: NIST Advanced Technology Program, the United States Department of Commerce, Contract No. 70NANBOH3053. The United States has certain rights in this invention.

TECHNICAL FIELD

The present invention relates to a method and apparatus for die-casting magnesium components from molten magnesium using a hot runner system in which both temperature and flow are controlled.

BACKGROUND OF THE INVENTION

Magnesium is an attractive material for application in motor vehicles because it is both a strong and lightweight material. The use of magnesium in motor vehicles is not new. Race driver Tommy Milton won the Indianapolis 500 in 1921 driving a car with magnesium pistons. A few years after that magnesium pistons entered mainstream automotive production. By the late 1930's over 4 million magnesium pistons had been produced. Even in the early days of car production, the weight-to-strength ratio of magnesium, compared with other commonly-used materials, was well-known.

Considering the recent increase in fuel prices driven largely by increased global demand, more attention is being given to any practical and economically viable step that can be taken to reduce vehicle weight without compromising strength and safety. Accordingly, magnesium is increasingly becoming an attractive alternative to steel, aluminum and polymers, given its ability to simultaneously meet crash-energy absorbing requirements while reducing the weight of vehicle components. Having a density of 1.8 kg/L, magnesium is 36% lighter per unit volume than aluminum (density=2.70 kg/L) and is 78% lighter per unit volume than steel (density=7.70 kg/L). Magnesium alloys also hold a competitive weight advantage over polymerized materials, being 20% lighter than most conventional glass reinforced polymer composites.

Beyond pistons, numerous other vehicle components are good candidates for being formed from magnesium, such as inner door panels, dashboard supports and instrument panel support beams. In the near-term it is anticipated that components made from magnesium for high volume use in the motor vehicle might also include powertrain, suspension and chassis components.

The fact that the surface "skin" of die-cast magnesium has better mechanical properties over the bulk than more commonly used materials, thinner (ribbed) and lighter die-castings of magnesium can be produced to meet their functional requirements. Such components can have sufficiently high strength per unit area to compete with more common and heavier aluminum and plastic components. Furthermore, magnesium has considerable manufacturing advantages over other die-cast metals, such as aluminum, being able to be cast closer to near net-shape thereby reducing the amount of material and associated costs. Particularly, components can be routinely cast at 1.0 mm to 1.5 mm wall thickness and 1 to 2 degree draft angles, which are typically ½ that of aluminum. The extensive fluid flow characteristics of magnesium offers a single, large casting to replace a plurality of steel fabrications. Magnesium also has a lower latent heat and reduced tendency for die pick-up and erosion. This allows a reduced die-casting machine cycle time (~25% higher productivity) and 2 to 4 times longer die life (from 150-200,000 to 300-700,000 shots) compared with that of aluminum casting.

However, the use of magnesium in automotive components is burdened with certain drawbacks. While magnesium is abundant as a natural element, it is not available at a level to support automotive volumes. This situation causes hesitation among engineers to design and incorporate magnesium components. On the occasion when the magnesium is selected as the material of choice, designers fail to integrate die-casting design with manufacturing feasibility in which the mechanical properties, filling parameters, and solidification profiles are integrated to predict casting porosity and property distribution.

The raw material cost of magnesium relative to other commonly used materials is also an impediment to mass implementation in the automotive industry. Current techniques for casting parts from magnesium make expanding the use of magnesium into a broader array of products less attractive. Presently, all large die-castings are produced in high pressure, cold-chamber machines where the metal is injected from one central location. This approach results in inferior material properties and waste material.

Accordingly, in order to make the use of magnesium in the production of vehicle components more attractive to manufacturers, a new approach to product casting is needed. This new approach is the focus of the present invention.

SUMMARY OF THE INVENTION

The present invention represents an advancement in the technique of casting components from magnesium and other metals. The primary objective of the present invention is to provide a multi-point injection, hot runner system for introducing molten magnesium into production die cavities at a controlled temperature and flow rate. The method and apparatus of the present invention provides an approach that minimizes waste while maximizing manufacturing repeatability. This provides a cost-effective and practical solution to the problems ordinarily associated with current approaches to die-casting magnesium.

This invention accomplishes these and other objectives by utilizing a self-contained and enclosed system that maximizes control over heat and molten metal flow while minimizing contamination. The system utilizes a gooseneck in which a plunger draws molten metal from a molten metal crucible and directs the molten metal to a hot runner assembly via a machine nozzle. The molten metal exits the hot runner assembly into a mold cavity through the tip of the hot runner which is provided to gate directly on or very near the part surface.

Each of the machine nozzle, the hot runner assembly, and the hot runner tip is heated by adjacent heating elements which may be coil heaters, tubular heaters or band heaters. By providing such an array of heaters the temperature of the molten metal can be readily and accurately maintained.

Flow of the molten metal is regulated by use of the gooseneck plunger which incorporates an internal reciprocating piston to selectively draw molten metal from a crucible into which the plunger is at least partially submerged. Once the gooseneck plunger channel is filled with molten metal the direction of the piston is changed and the molten metal is forced under pressure out of the gooseneck and into the machine nozzle. A preferred and accurate pressure is maintained by the amount of force applied by the piston upon the molten metal. This pressure is maintained evenly throughout the system such that the molten metal moves at a constant, regulated flow out of the gooseneck and through the machine nozzle, the hot runner assembly, the hot runner tip, and into the cavity.

To maintain this constant pressure or zero pressure difference by avoiding the return of molten metal back into the gooseneck when the piston extracts or moves to apply pressure to the molten metal, a one-way (or non-return) check valve is also incorporated into the plunger to prevent such an outflow. During the extraction step a thermal valve ("TV") is formed at the tip of the hot runner assembly, thus preventing flow of molten metal from the mold cavity and back into the hot runner tip. With this arrangement the molten metal is retained in and completely fills entire feeding system. This is necessary because magnesium molten metal needs to be present in the machine nozzle at all times, before and after each shot.

Attached to the check valve is a pipe which is fitted so as to allow the inflow of molten metal only from the upper portion of the molten metal-holding crucible. This assures that only that metal most free of impurities will be used in the casting process.

The formed thermal valve blocks the flow of molten metal back into the hot runner tip during ejection and application of the die lubricant. The thermal valve is formed at the tip of the hot runner. The tip of the hot runner is fitted with a heating element so that its temperature may be heated to a regulated temperature. The operation of the hot runner tip is closely controlled as it also determines the cycle time of the process. The temperature of the hot runner tip may be computer controlled by a pre-programmed feedback controller.

Temperature regulation of the hot runner tip is necessary to form the thermal valve which is a blockage of solid metal between the in-flowing molten metal and the mold cavity. The blockage is formed to prevent the back-flow of molten metal out of the cavity and back into the machine nozzle or gooseneck at the end of the shot. In addition, no pressure difference arises in the feeding system after the shot. The formation of the thermal valve is accomplished by a balance of both temperature regulation and tip opening geometry.

With respect to temperature regulation, if the temperature at the hot runner tip is too high for the given metal, then the thermal valve will not form at the end of the shot and the molten metal will back-flow into the gooseneck, allowing air to enter the system and compromising the quality of the component made from the next shot since exposure to air results in a component having relatively high porosity while exposure to oxygen leads to oxidation of the resulting component.

On the other hand, if the temperature at the tip is too low for the given metal, then the thermal valve will be oversized and will be formed too deep into the hot runner assembly. This condition will make it very difficult to re-melt the blockage for the next casting shot since an excessive amount of heat will be needed to re-melt the thermal valve. The needed excess amount of heat will make it difficult for the formation of a thermal valve in the subsequent shot.

Between these two extremes is the ideal temperature condition under which a blockage of solid metal is formed in the immediate area of the opening at the tip. The ideal amount of blockage is that which will prohibit the back-flow of molten metal into the machine nozzle or gooseneck after the die opens and will not excessively block the molten metal passageway during the next shot after the die is re-closed.

With respect to tip opening geometry, if the opening is too small, then the amount of molten metal allowed to pass will be too small to fill the cavity during the shot and the heat necessary to assure the flow of metal will be too great to permit the formation of a blockage. If the opening is too large, the flow of molten metal through the apparatus will be too fast to allow time for the heating element of the thermal valve to provide proper temperature regulation of the passing metal. Accordingly, the temperature of the thermal valve and the size of the tip opening are related and must be balanced to form the appropriate blockage at the tip opening.

By providing a method and apparatus according to the present invention, several advantages are achieved. First, the quality and consistency of die castings is improved. This is because less air is entrained, avoiding the chemical reaction of air with the molten metal. Second, reductions in cycle time and machine clamping force are achieved. Cycle time is reduced because molten metal is already present at a desired pressure and temperature within the entire course of the feeding system. A reduction in clamping force is achieved because the opening of the hot runner tip is small compared with the traditional sprue which is ordinarily much larger. Third, less waste and less recycling of material is achieved.

Other advantages and features of the invention will become apparent when viewed in light of the detailed description of the preferred embodiment when taken in conjunction with the attached drawings and the appended claims.

BRIEF DESCRIPTION OF THE DRAWINGS

For a more complete understanding of this invention, reference should now be made to the embodiment illustrated in greater detail in the accompanying drawings and described below by way of examples of the invention wherein.

DETAILED DESCRIPTION OF THE PREFERRED EMBODIMENT

Figure 1:
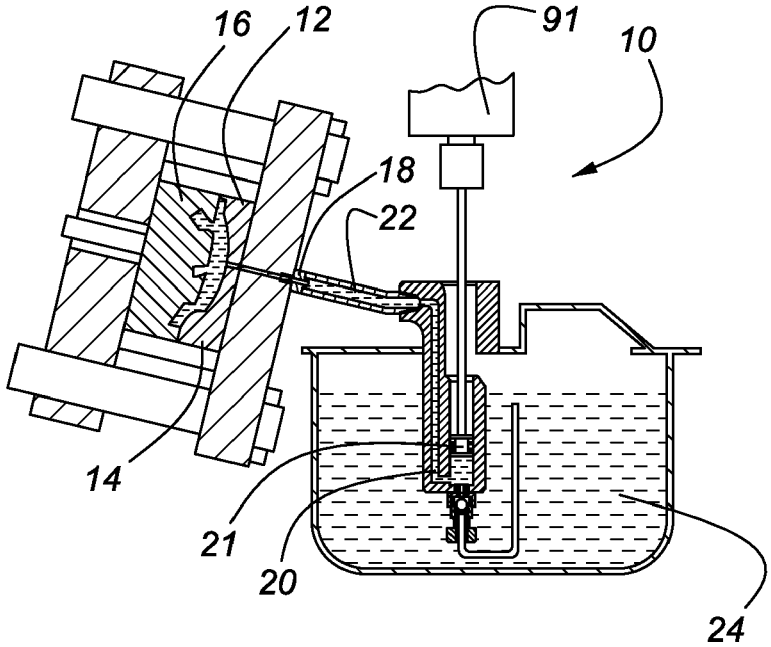
FIG. 1 illustrates an diagrammatic view of a casting apparatus utilizing the hot runner arrangement according to the present invention.

In the following figures, the same reference numerals will be used to refer to the same components. In the following description, various operating parameters and components are described for one constructed embodiment. These specific parameters and components are included as examples and are not meant to be limiting.

With reference to FIG. 1, a diagrammatic view of the hot chamber apparatus of the present invention is illustrated, being generally illustrated as 10. The apparatus 10 is entirely self-enclosed, preventing atmospheric exposure of the liquid melt. It is to be understood that while the present invention is directed at the formation of components from molten magnesium alloy, other metals including zinc may be used.

The hot chamber 10 includes a casting die 12. The casting die 12 includes a cover half 14 and an ejector half 16, a hot runner assembly 18 partially recessed within the cover half 14 of the casting die 12, a gooseneck 20, a shot plunger 21 operatively associated with the gooseneck 20, and a machine nozzle 22 fitted between the hot runner assembly 18 and the gooseneck 20. A substantial portion of the gooseneck 20 is submerged within a crucible 24 of molten metal.

Figure 2:
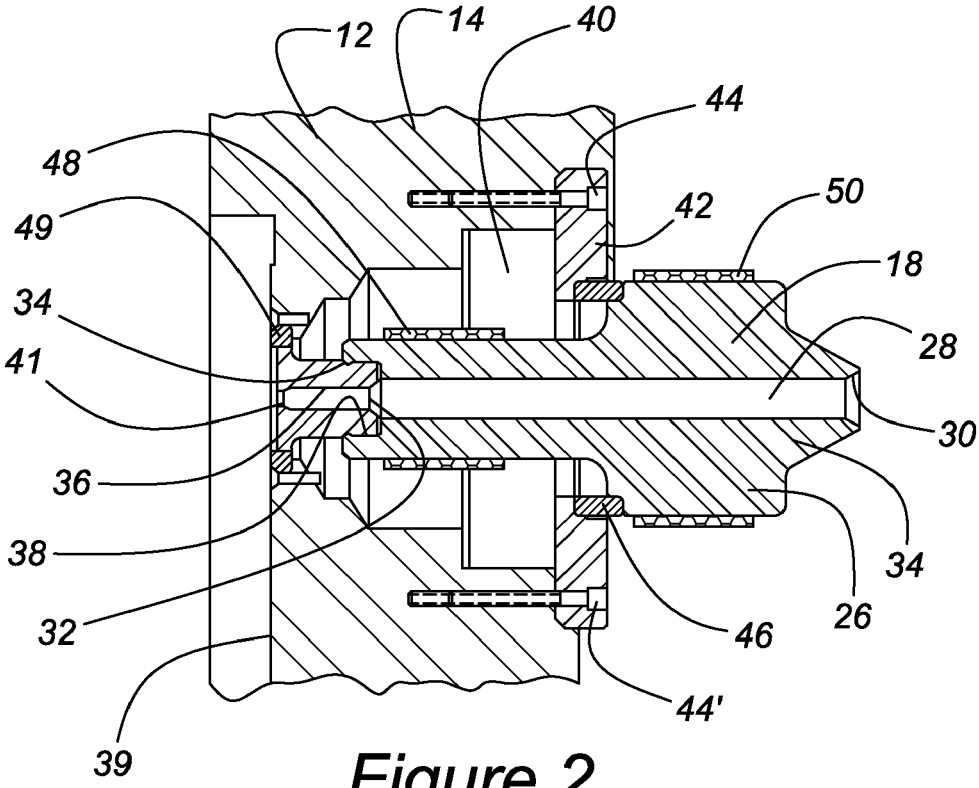
FIG. 2 illustrates a sectional view of a hot runner assembly in position relative to a die according to the present invention.
Figure 5:
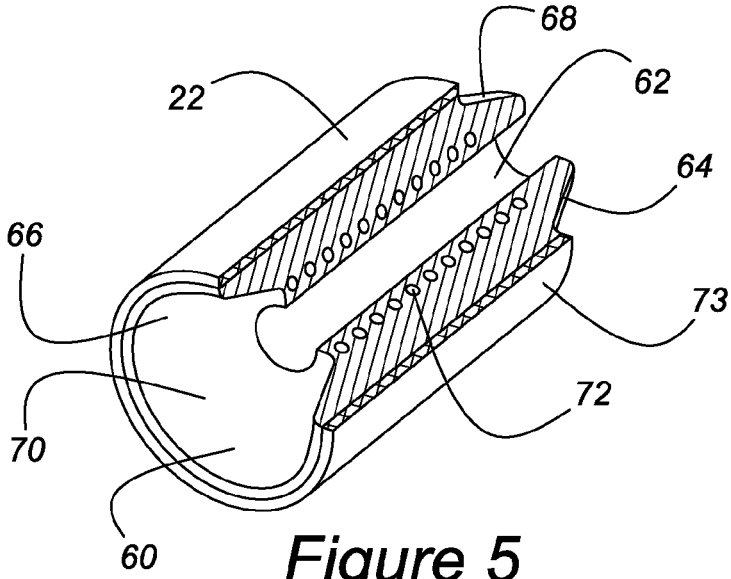
FIG. 5 illustrates a perspective and partially sectioned view of a machine nozzle according to the present invention.

Referring now to FIG. 2, a sectional and detailed view of the hot runner assembly 18 is illustrated. As noted above, the hot runner assembly 18 is partially recessed within the cover half 14 of the casting die 12. The hot runner assembly 18 consists of a hot runner body 26 having a long axis along which a molten metal passage 28 is formed. The hot runner body 26 includes a molten metal input end 30 and a molten metal output end 32. The molten metal input end 30 includes an outer cone 34 which can be inserted into a receiving end of the machine nozzle 22 as shown in FIG. 5 and as discussed in relation thereto.

With reference still to FIG. 2, the molten metal output end 32 includes a cavity 36 defined therein into which a hot runner tip 38 is partially positioned. The outward end of the hot runner tip 38 terminates at a part line 39 formed between the cover half 14 and ejector half 16 of the casting die 12. The hot runner tip 38 includes an end 41 that is open to the mold cavity.

The hot runner tip 38 is provided to establish thermal valving in the apparatus 10 whereby a thermal plug (shown in FIG. 4 and discussed in relation thereto) is formed at the orifice outlet of the hot runner body 26. The opening of the hot runner tip 38 may be of a variety of possible sizes, although an orifice size of about 8 mm provides an effective configuration. The objective of the hot runner tip 38 is to prevent the flow of molten magnesium downwards into the gooseneck 20 during each complete casting cycle because of the ability of the thermal plug formed adjacent the die cavity by the hot runner tip 38 to retain the pressure difference in the hot runner assembly 18 and the gooseneck 20.

The hot runner body 26 is positioned in a hot runner body cavity 40 which is recessed within the cover half 14 of the casting die 12. The hot runner body 26 is held in place by a support ring 42 which may be fastened to the cover half 14 of the casting die 12 by conventional means such as by mechanical fasteners 44, 44'.

It is important in the operation of the apparatus 10 that the molten metal be maintained at high temperatures at all stages between the crucible 24 and the die 12. Accordingly, a series of insulators and heaters are provided to maintain the needed temperatures. To this end the hot runner assembly 18 includes both insulators and heaters. A hot runner body insulator ring 46 is fitted between the hot runner body 26 and the support ring 42. A thermal valve insulator ring 49 is fitted between the hot runner tip 38 and the cover half 14 of the casting die 12. The hot runner body insulator ring 46 and the thermal valve insulator ring 49 are formed from a known insulating material.

To keep the hot runner assembly 19 as uniform a temperature as possible external heaters are applied. As illustrated in FIG. 2, a pair of spaced-apart band heaters 48 and 50 is fitted to the hot runner body 26. The band heaters 48 and 50 are electrically powered and are controlled in a known manner.

Figure 3:
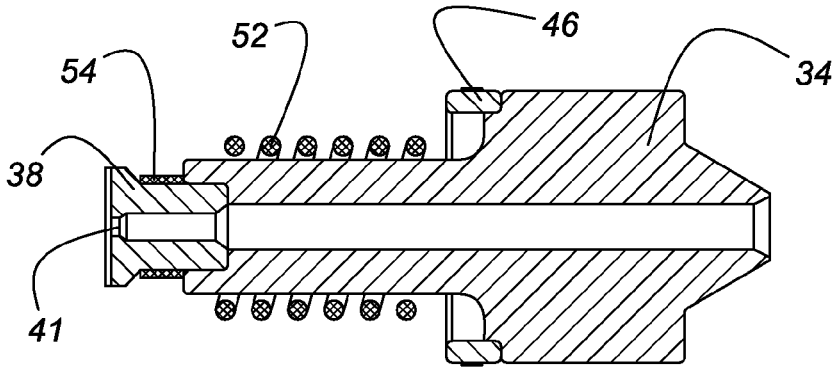
FIG. 3 illustrates a sectional view of the hot runner body of FIG. 2 illustrating an alternate arrangement for heating.

In addition or as an alternative to the use of band heaters as illustrated in FIG. 2, coil or tubular heaters may also be used to create and maintain the desired level of heat in the hot runner assembly 18. An example of such an alternative is illustrated in FIG. 3 where a coil heater 52 is fitted to the hot runner body 26 in lieu of the band heater 48. As a further modification, a hot runner tip band heater 54 is shown in FIG. 3 externally positioned on the hot runner tip 38. Other variations may be possible provided the objective of establishing and regulating the desired levels of heat with respect to the hot runner body 26 is achieved. Accordingly, the application of heat using bands and coils as shown is intended as being illustrative and not limiting.

Figure 4:
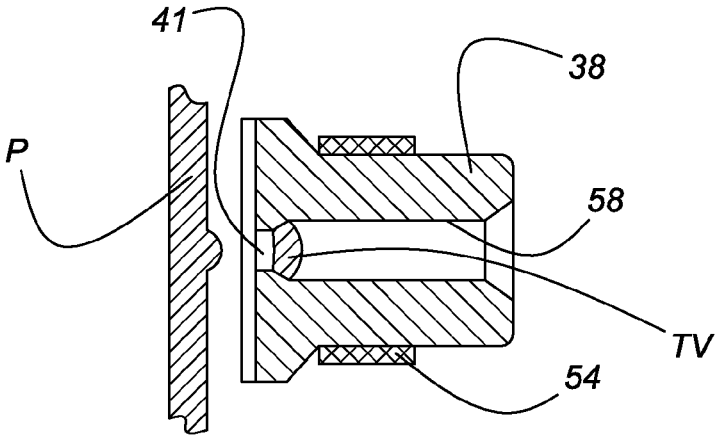
FIG. 4 illustrates a sectional view of the thermal valve according to the present invention in relation to a portion of a cast part.

Referring now to the hot runner tip 38, this component is illustrated in sectional view in FIG. 4 and is shown in relation to a portion of a cast part "P". The cast part P is illustrated as having been removed from the mold cavity and thus separated from the hot runner tip 38. A molten metal passage 58 is defined along the long axis of the hot runner tip 38. The hot runner tip 38 may be threadably attached to the hot runner body 26 or may be attached by other mechanical means.

The hot runner tip heater 54 is provided to keep the hot runner tip 38 at a pre-selected temperature such that the metal at the end 41 may flow freely into the mold cavity during the plunger shot but will form a solid blockage once the shot is completed. Accordingly, there is a temperature differential between the end 41 and the hot runner tip 38. This temperature differential means that the area of the opening of the hot runner tip 38 into the mold cavity will be cooler than the rest of the hot runner tip 38, thus allowing the molten metal in the immediate area of the tip to cool and become solidified locally in the area of the tip. This arrangement prevents molten metal from leaking from the cavity and back into the hot runner tip 38 at the end of the shot.

The temperature differential is dependent upon the metal being used to make the cast component. By way of example, magnesium alloy (for example, AZ91) becomes solid at 470° C. and is fully molten at temperatures over 595° C. Accordingly, the temperature of the hot runner tip 38 must be such that the metal therein is molten to allow it to flow. Conversely, the temperature at the end 41 of the hot runner tip 38 that is open to the mold cavity must be cooler than that of the rest of the hot runner tip 38 and specifically must approach, but not necessarily meet, the temperature of 470° C. at which magnesium alloy is solid. Of course, the temperature of the thermal valve 38 may be adjusted up or down depending on the metal alloy being used.

As illustrated in FIG. 4, a thermal valve "TV" of an ideal size and configuration has been formed within the hot runner tip 38. The thermal valve TV prevents the back-flow of molten metal into the hot runner tip 38 after the completion of the shot.

The machine nozzle 22 is illustrated in FIG. 5. A quarter of the machine nozzle 22 has been removed for illustrative purposes. The machine nozzle 22 includes a machine nozzle body 60 having a molten metal passage 62 defined along its long axis. The machine nozzle 22 also includes a molten metal input end 64 which has an outer cone 68 to mate with the gooseneck 20. The machine nozzle 22 also has a molten metal output end 66 defined as a conical cavity 70 which mates with outer cone 34 of the molten metal input end 30 of the hot runner assembly 18.

As noted above, it is important to establish and maintain desired temperatures at all points between the crucible 24 and the die 12. Accordingly, the machine nozzle 22 is also provided with a heating element. Two forms of heating elements are illustrated in FIG. 5. The first form is heating element 72 which is a coil-type heating system. The second form is heating element 73 which is a band heater. The coil, band, or tubular form of heating elements may be used, alone or in combination.

Figure 6:
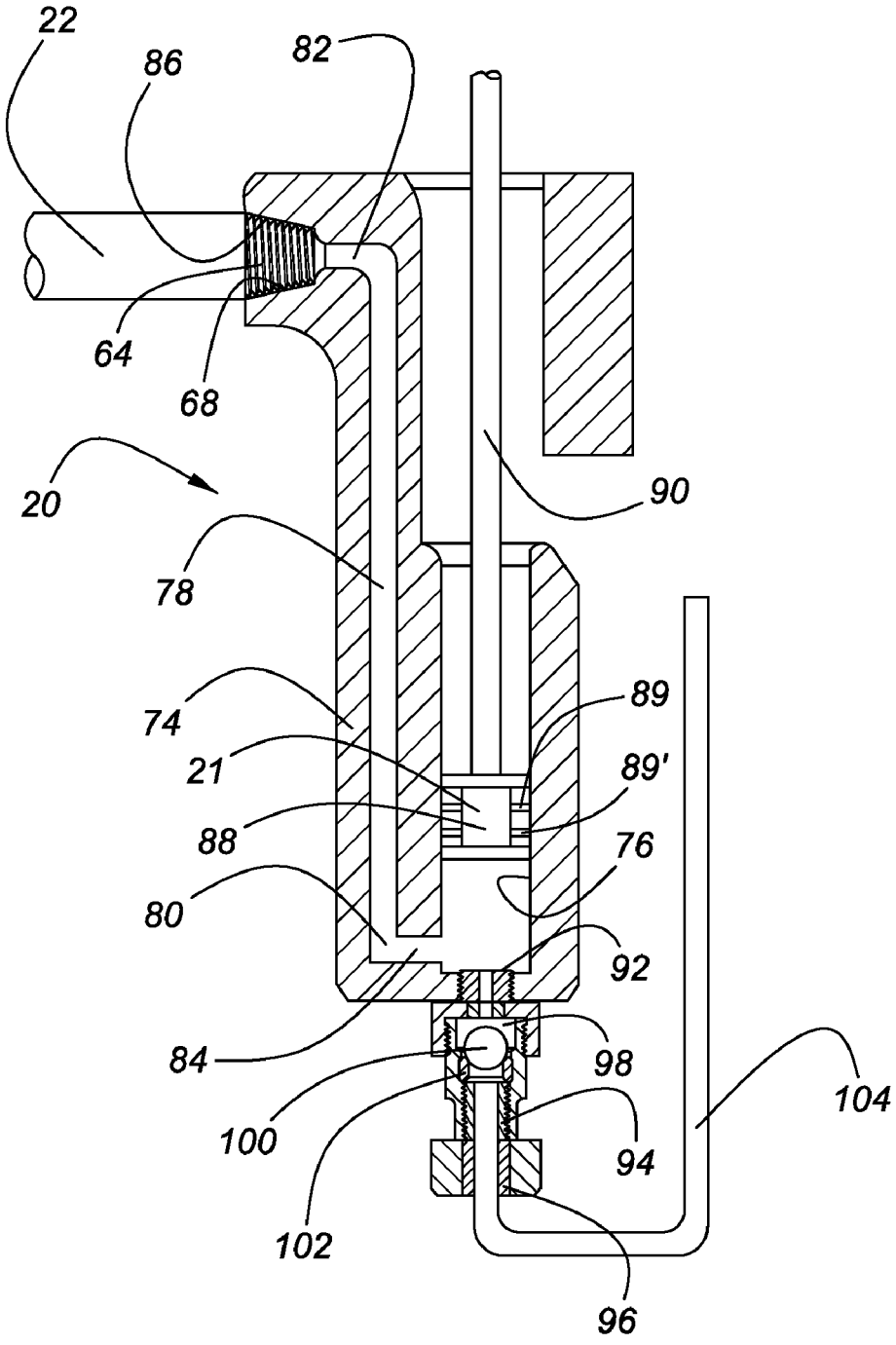
FIG. 6 illustrates a sectional view of a single plunger and check valve assembly in a gooseneck according to the present invention.

Delivery of the molten metal from the crucible 24 to the machine nozzle 22 is accomplished by the gooseneck 20. The gooseneck 20 is detailed in sectional view in FIG. 6. The gooseneck 20 may be made of a superalloy steel. The gooseneck 20 includes a gooseneck body 74 and the shot plunger 21. The gooseneck body 74 includes a plunger cylinder 76 for the shot plunger 21 and a molten metal passageway 78. The plunger cylinder 76 and the molten metal passageway 78 are substantially parallel to one another, with the diameter of the plunger cylinder 76 being larger than the diameter of the molten metal passageway.

The molten metal passageway 78 includes an inlet end 80 and an outlet end 82. The inlet end 80 is in fluid communication with the plunger cylinder 76 by way of a molten metal channel 84. The outlet end 82 terminates at a plunger molten metal outlet port 86. The plunger molten metal outlet port 86 is preferably of a conical configuration so as to mate snugly with the outer cone 68 of the machine nozzle molten metal input end 64.

The shot plunger 21 includes a piston head 88 and a plunger drive shaft 90 which selectively drives the piston head 88. The plunger drive shaft 90 reciprocates within the plunger cylinder 76. A pair of sacrificial metal rings 89 and 89' is fitted to the piston head 88. The rings 89 and 89' are sacrificial and are intended to be worn instead of the piston head 88 during operation. Accordingly, the need to replace the piston head 88 at regular intervals is avoided. The plunger drive shaft 90 is attached to a plunger drive mechanism 91 (shown in FIG. 1).

The plunger cylinder 76 includes a molten metal inlet end 92. A check valve assembly 94 is fitted to the molten metal inlet end 92 at the base of the gooseneck 20 for controlling entry of the molten metal into the plunger cylinder 76 from the crucible 24. The check valve assembly 94 is needed to make repeatable castings per casting shot by assuring that the hot runner assembly 18 and the gooseneck 20 are always filled with molten metal.

The check valve assembly 94 includes an inlet end 96 and an outlet end 98. Between the inlet end 96 and the outlet end 98 of the check valve assembly 94 is a check valve ball 100. The check valve ball 100 is shown in its closed position on a check valve ball seat 102. A molten metal inlet tube 104 is optionally though preferably fitted to the inlet end 96 of the check valve assembly 94. This arrangement allows for purer molten metal to be drawn from the upper end of the crucible 24 than might be drawn from the lower end of the crucible 24.

The check valve ball 100 is movable between the illustrated closed position where the check valve ball 100 is positioned on the check valve ball seat 102 and an open position (not shown) where the check valve ball 100 is lifted off of the check valve ball seat 102. Particularly, molten metal is drawn from the crucible 24 into the plunger cylinder 76 when the piston head 88 is moved in a direction away from the molten metal inlet end 92 by suction. This action urges the check valve ball 100 to be moved from its closed position, resting upon the check valve ball seat 102, to its open, molten metal-passing position (not shown) whereupon molten metal may be allowed to pass through the check valve assembly 94 unrestricted by the check valve ball 100. Once the plunger cylinder is filled with molten metal, the piston head 88 is moved in an opposite direction, that is, it is moved toward the molten metal inlet end 92. This movement forces the molten metal against the check valve ball 100 such that it is moved against and seated upon the check valve ball seat 102. The molten metal is then forced through the molten metal channel 84, into the molten metal passageway 78, through the outlet end 82 and into the machine nozzle 22.

Figure 7:
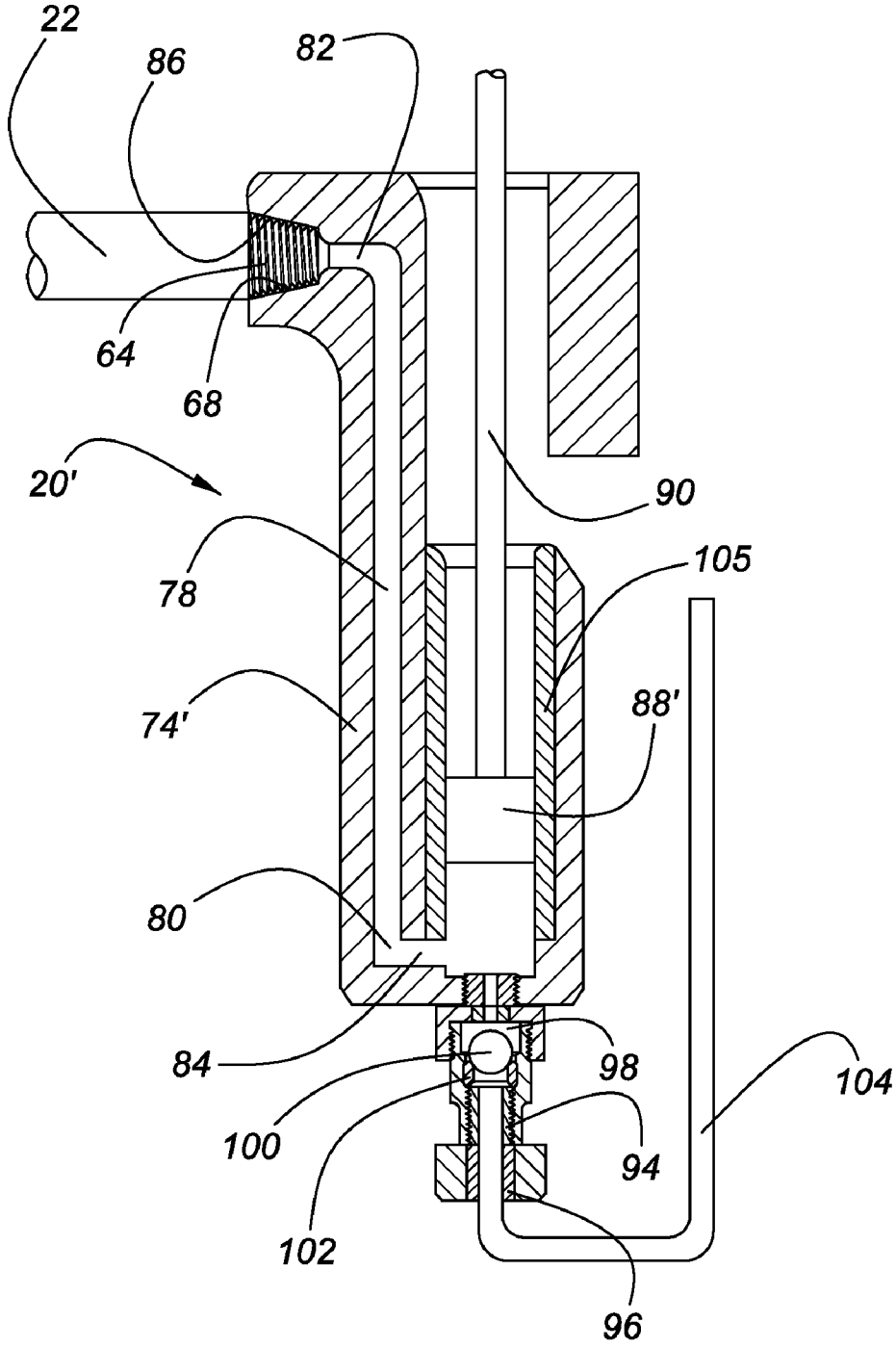
FIG. 7 illustrates a sectional view of an alternate embodiment of the single plunger and check valve assembly in a gooseneck according to the present invention wherein a liner is used to line the plunger cylinder.

As noted above with reference to FIG. 6, a pair of sacrificial rings 89 and 89' is provided to endure the operational wear instead of the piston head 88. This wear is the result of the metal-to-metal contact between the sacrificial rings 89 and 89' and the wall of the plunger cylinder 76. An alternative approach to the use of the sacrificial rings 89 and 89' is illustrated in FIG. 7 where a gooseneck 20' is illustrated. The gooseneck 20' includes a gooseneck body 74' and a piston head 88'. With the exception of the design and construction of the gooseneck body 74' and the piston head 88', the gooseneck 20' includes elements that are preferably identical in design and function to those of the gooseneck 20 discussed above and shown in FIG. 6. Accordingly, only the differences will be discussed.

The gooseneck body 74' is configured so as to eliminate the need of having to change sacrificial rings. Accordingly, the piston head 88' is provided without sacrificial rings. This is accomplished by use of a ceramic liner 105. The ceramic liner is a sleeve that is shrink-fitted within the gooseneck body 74'. The ceramic liner 105 may be composed of a variety of ceramic materials, but preferably is composed of a silicon nitride material such as SN-240 manufactured by Kyocera. Other ceramic materials may be used as an alternative to silicon nitride. By using a ceramic liner in the gooseneck 20' the metal-to-metal wear of the arrangement of the gooseneck 20 is eliminated.

Regardless of whether the gooseneck 20 or the gooseneck 20' is used, once the molten metal enters the machine nozzle 22 its movement is continued by the action of the piston head 88 through the machine nozzle 22 and into the hot runner body 26. Passing through the hot runner body 26, the molten metal next proceeds through the hot runner tip 38 and into a cavity in the die 12. This procedure represents the most fundamental aspect of the invention. The molten metal proceeds from the gooseneck 20 through to the casting die 12 with both the temperature and the rate of flow being fully controlled by external operations (not shown).

Figure 8:
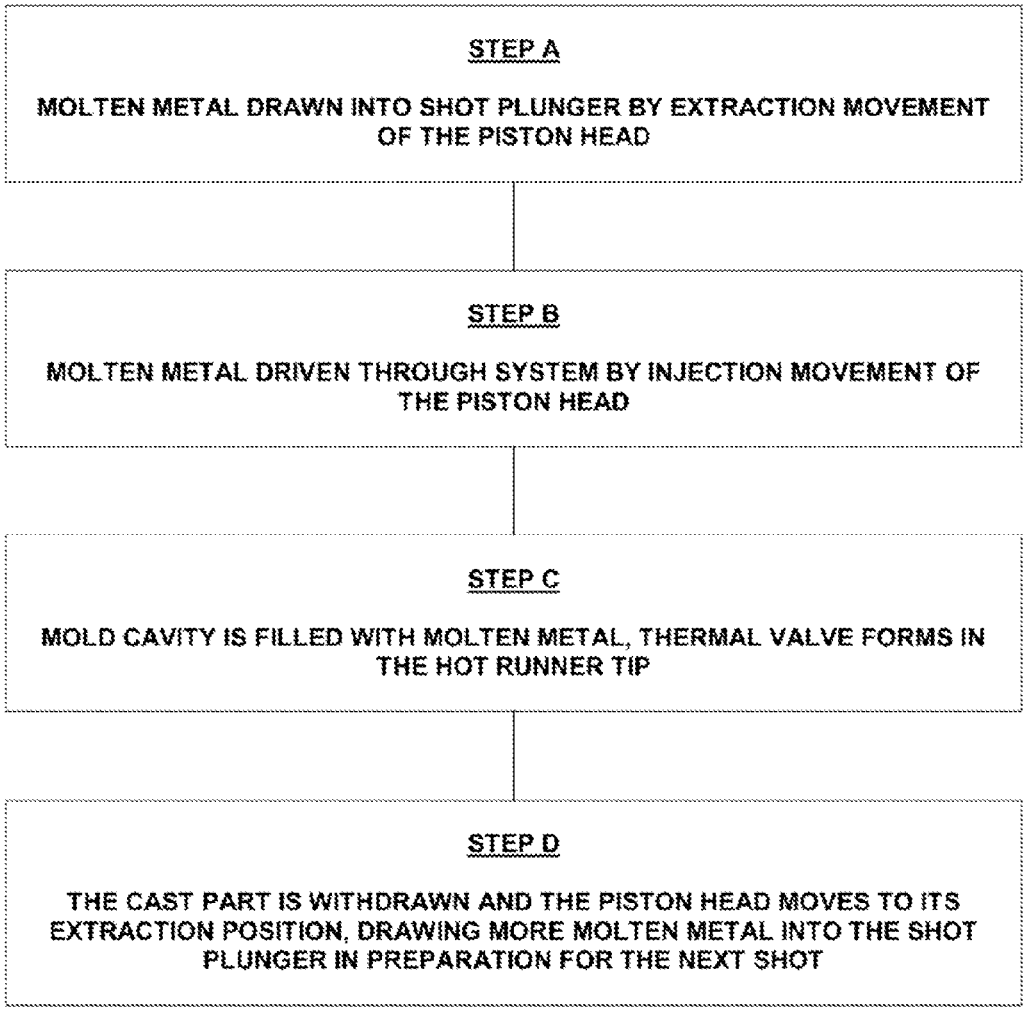
FIG. 8 illustrates a general flow chart of the method of the present invention.

A flow-chart of the method of the present invention is set forth in FIG. 8. With reference thereto, at Step A, molten metal is drawn from the crucible into the shot plunger cylinder by movement of the piston head to its extraction position. The check valve is in its open position and thus permits the flow of molten metal thereby. A thermal valve has been formed in the hot runner tip at the end of the prior shot, thus prohibiting the back-flow of molten metal from the mold cavity back into the hot runner assembly during movement of the piston head to its extraction position. The existence of the thermal valve assures that there is no pressure differential through the feeding system between the opening of the hot runner tip and the shot plunger cylinder.

At Step B the piston head moves toward its injection position thereby closing the check valve and forcing the molten metal through the feeding system. The temperature of the hot runner tip is raised to a point above the melting point of the selected metal and this, in combination with the pressure of the molten metal now being forced through the system, causes the thermal valve to re-melt, permitting the flow of molten metal through the system and into the mold cavity.

Once the piston head has moved to its fully injected position at Step C whereby the mold cavity is filled, the temperature of the hot runner tip is allowed to drop to a point below the melting point of the selected metal. This allows the thermal valve to form within the hot runner tip. The formed part may be removed after cooling.

At Step D, the thermal valve remains in its blocking position, thus allowing the piston head to again move to its extracting position for the next shot.

Figure 9:
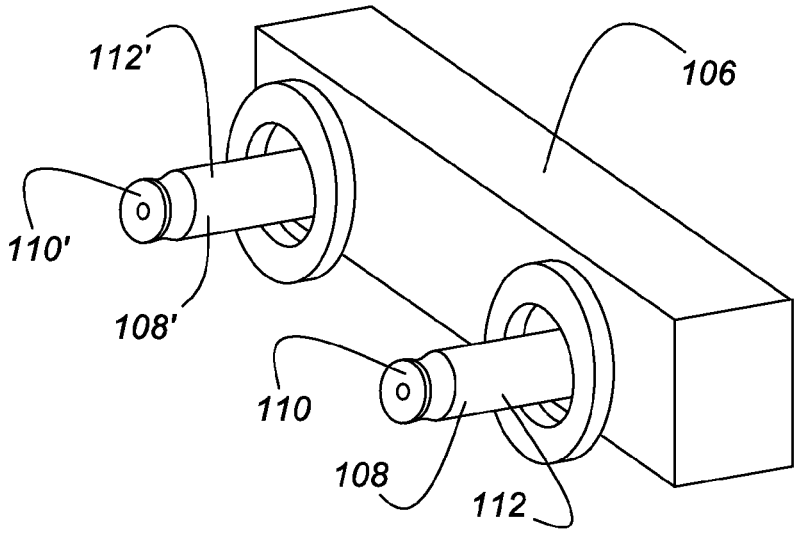
FIG. 9 illustrates a perspective view of a twin injector hot runner manifold according to an alternate embodiment of the present invention.
Figure 10:
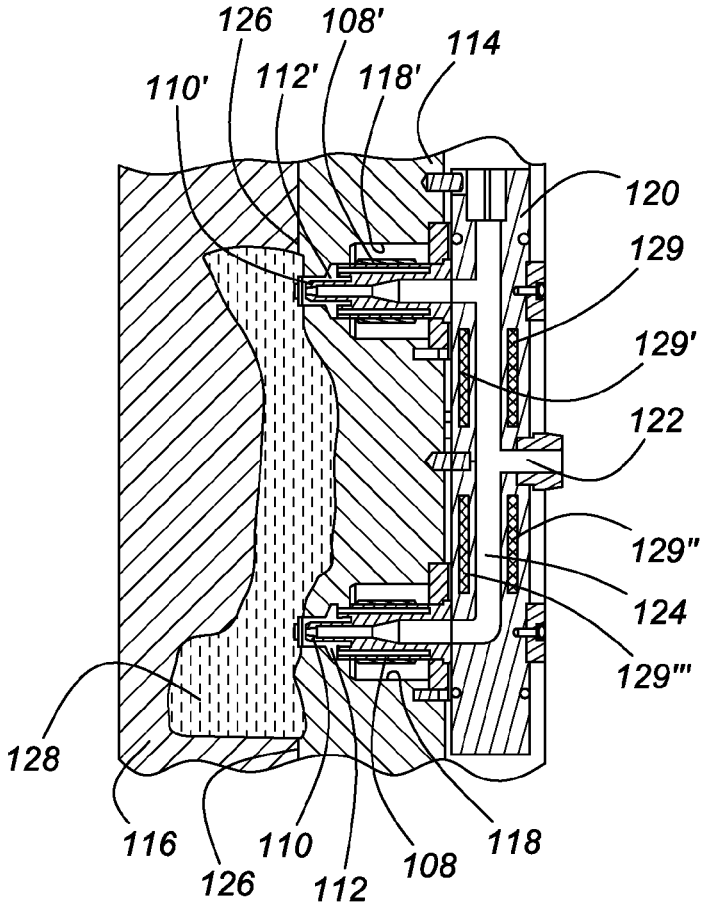
FIG. 10 illustrates a sectional view of the twin injector hot runner manifold of FIG. 9 in conjunction with a die.
Figure 11:
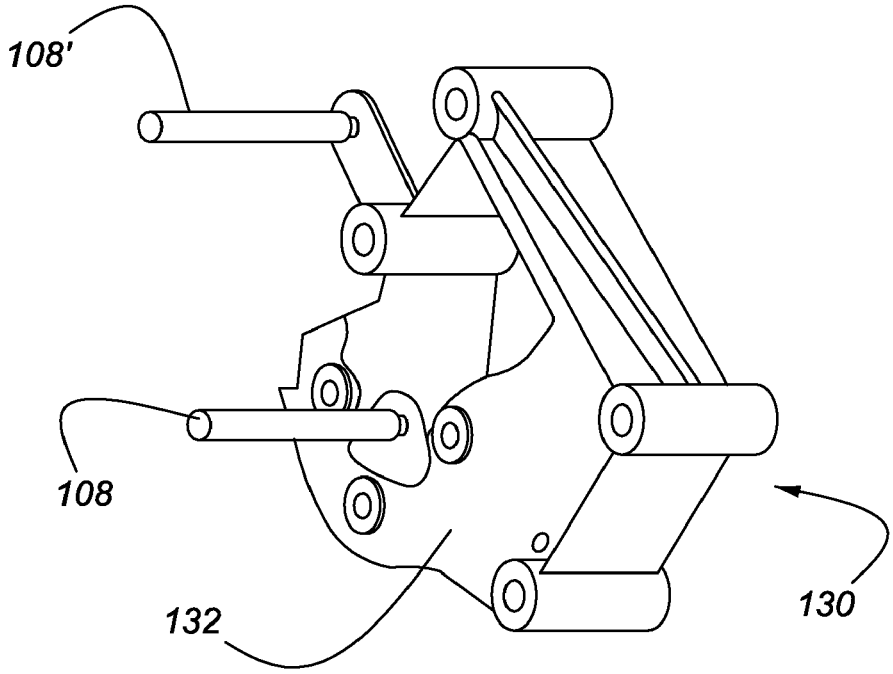
FIG. 11 illustrates a perspective view of a component cast in the die of FIG. 9.
Figure 12:
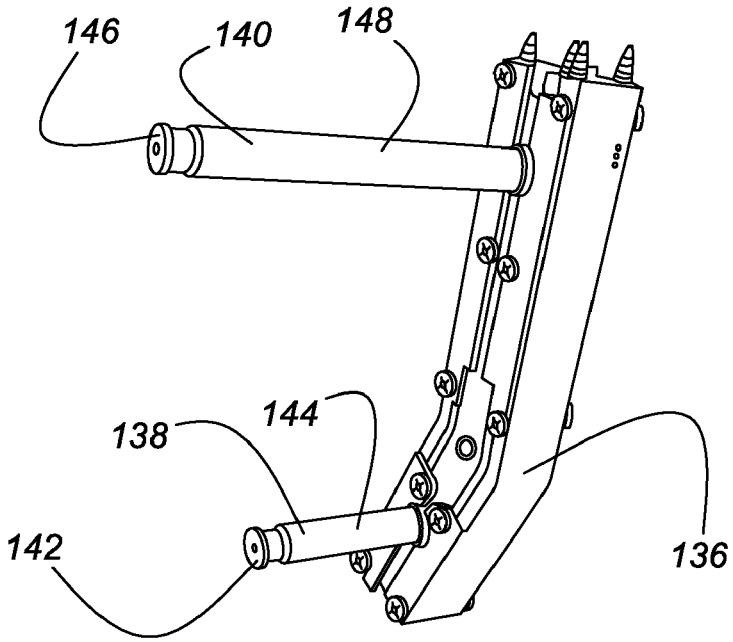
FIG. 12 illustrates a perspective view of a twin injector hot runner manifold according to an alternate embodiment of the present invention.
Figure 13:
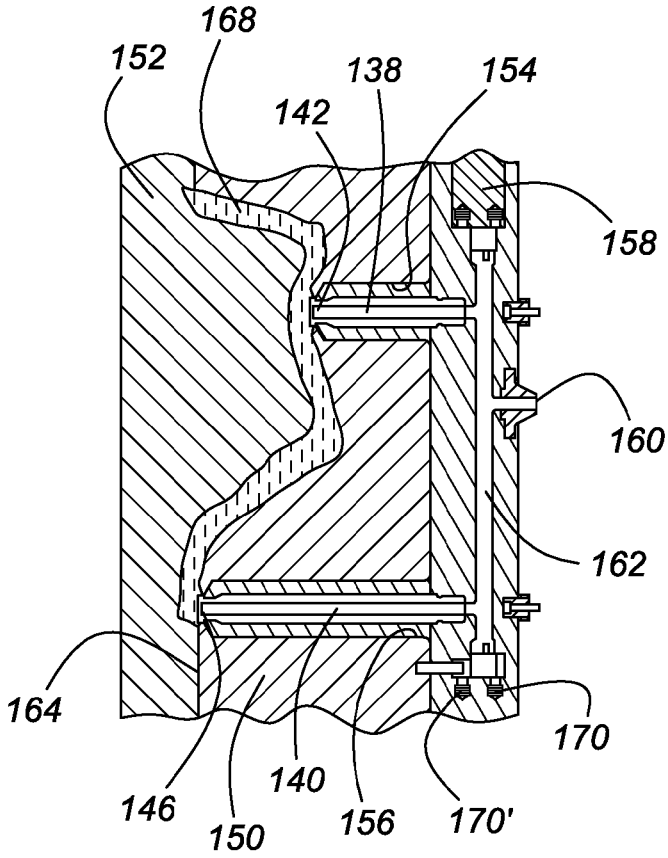
FIG. 13 illustrates a sectional view of the twin injector hot runner manifold of FIG. 12 in conjunction with a die.
Figure 14:
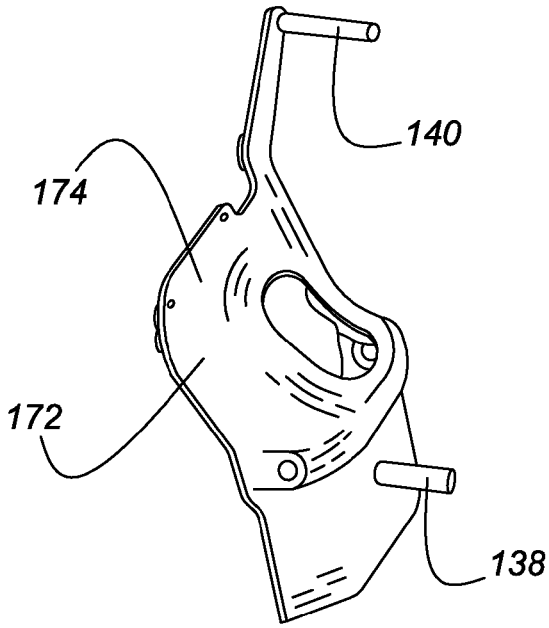
FIG. 14 illustrates a perspective view of a component cast in the die of FIG. 12.
Figure 15:
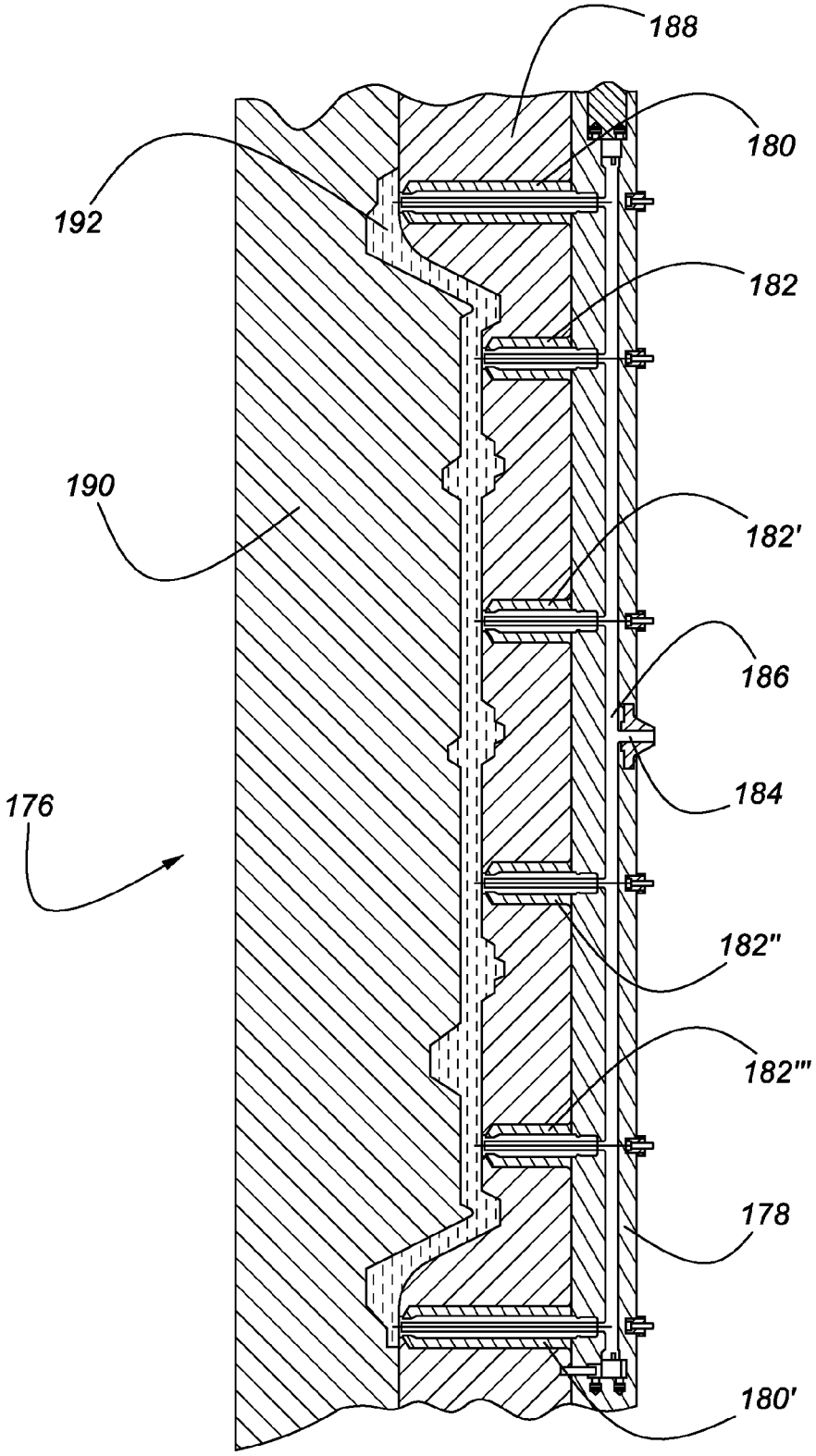
FIG. 15 illustrates a sectional view of a multiple injector hot runner manifold according to an alternate embodiment of the present invention.

The single port injector arrangement shown in FIG. 1 and discussed in conjunction therewith has application for simple casting configurations. However, the method and apparatus of the present invention may be used for more complex applications than that permissible with the single port injector arrangement. Specifically, the method and apparatus of the present invention may be extended to larger components of varying shapes and sizes where multiple injectors are used in conjunction with a manifold. Such alternate arrangements are shown and described in FIGS. 9 through 15. A manifold arrangement for forming a component of moderate complexity is shown in FIGS. 9 through 11. A manifold arrangement for forming a component of greater complexity is shown in FIGS. 12 through 14. An arrangement for making a large part is shown in FIG. 15. Regardless of the level of complexity, the molten metal delivery system described in the preceding figures will be suitable for the manifolds described hereafter.

Referring first to FIGS. 9 through 11, a twin injector hot runner manifold 106 is illustrated. The twin injector hot runner manifold 106 includes a pair of spaced apart injectors 108 and 108' that comprise thermal valves 110 and 110' fitted to hot runners 112 and 112' along the lines of the thermal valve-hot runner arrangement shown in FIGS. 2 through 4 and discussed in conjunction therewith. As illustrated, the injectors 108 and 108' are essentially the same in size, shape and function.

The position of the injectors 108 and 108' relative to a cover die half 114 and an ejector die half 116 is illustrated in FIG. 10. The positioning of the injectors 108 and 108' is made to improve the filling pattern of the die. With respect thereto, the cover die half 114 includes a pair of spaced apart, injector-receiving cavities 118 and 118' formed therein. The injectors 108 and 108' are fitted respectively within the injector-receiving cavities 118 and 118'. Positioned adjacent the cover die half 114 is a manifold body 120 which includes a manifold inlet 122 which is in fluid communication with a manifold passageway 124. The manifold passageway 124 is itself in fluid communication with each of the injectors 108 and 108'. A machine nozzle (not shown) is fluidly connected with the manifold inlet 122 in the same manner as discussed above with respect to machine nozzle 22.

The open ends of the thermal valves 112 and 112' are positioned at a part line 126 between the cover die half 114 and the ejector die half 116. A component forming cavity 128 is formed between the cover die half 114 and the ejector die half 116. Manifold heaters 129, 129', 129" and 129'" are embedded within the manifold body 120 to maintain the desired level of heat. It is to be understood that a greater or lesser number of heaters 129, 129', 129" and 129'" may be used as desired and as necessary to achieve an adequate thermal profile. The illustrated heaters are of the tubular variety, but it should be understood that other configurations may be applicable.

In operation, the molten metal is forced from the machine nozzle (not shown) and into and through the manifold inlet 122, into and through the manifold passageway 124, into and through the injectors 108 and 108', and into the cavity 128. The resulting casting is a part, generally illustrated as part 130, shown in FIG. 11. The part 130 has a cover surface 132. As illustrated, one of the injectors, 108, is on the cover surface 132 of the part 130 and the other injector, 108', is off the part 130. This arrangement and others like it allow for the most efficient formation of the part 130.

In the event that a part is to be cast that has a more complex configuration than part 130, an alternative arrangement, shown in FIGS. 12 through 14, may be used. With reference thereto, a twin injector hot runner manifold 136 is illustrated. It is to be understood that the twin injector hot runner manifold 136 is exemplary and other configurations may be adopted without deviating from the spirit and scope of the present invention.

The twin injector hot runner manifold 136 includes a pair of spaced apart injectors 138 and 140. The positioning of the injectors 138 and 140 is made to improve the filling pattern of the die. As illustrated, the injectors 138 and 140 are of different lengths as is required to form the desired complex part. The injector 138 comprises a hot runner tip 142 and a hot runner 144. The injector 140 comprises a hot runner tip 146 and a hot runner 148. As with the thermal valves 110 and 110' and the hot runners 112 and 112' discussed above with respect to FIGS. 9 through 11, the hot runner tips 142 and 146 and the hot runners 144 and 148 function as the thermal valve-hot runner arrangement shown in FIGS. 2 through 4 and discussed in conjunction therewith.

The position of the injectors 138 and 140 relative to a cover die half 150 and an ejector die half 152 are illustrated in FIG. 13. With respect thereto, the cover die half 150 includes a pair of spaced apart, injector-receiving cavities 154 and 156 of which the first, the injector-receiving cavity 154, receives the injector 138 and the second, the injector-receiving cavity 156, receives the injector 140.

Positioned adjacent to the cover die half 150 is a manifold body 158 which includes a manifold inlet 160. The manifold inlet 160 is in fluid communication with a manifold passageway 162. The manifold passageway 162 is itself in fluid communication with each of the injectors 138 and 140. A machine nozzle (not shown) is fluidly connected with the manifold inlet 160 in the same manner as discussed above with respect to machine nozzle 22.

The open ends of the hot runner tips 142 and 146 are positioned at a part line 164 between the cover die half 150 and the ejector die half 152. A component forming cavity 168 is formed between the cover die half 150 and the ejector die half 152. A pair of manifold heaters 170 and 170' is embedded within the manifold body 158 and function as the series of manifold heaters 129, 129', 129" and 129'" embedded within the manifold body 120 shown in FIG. 10. As with manifold heaters 129, 129', 129" and 129'" it is to be understood that a greater or lesser number of heaters 170 and 170' may be used as desired and as necessary to achieve an adequate thermal profile.

In operation, the molten metal is forced from the machine nozzle (not shown) and into and through the manifold inlet 160, into and through the manifold passageway 162, into and through the injectors 138 and 140, and into the mold cavity 168. The resulting casting is a relatively complex, multi-dimensional part, generally illustrated as part 172, shown in FIG. 14. The part 172 has a cover surface 174. Similar to the part 130 shown above in FIG. 11, one of the injectors, 138, is on the cover surface 174 of the part 130 and the other injector, 140, is off the part 172. This arrangement and its variations allow for the most efficient formation of the part 172.

A further use of the invention disclosed herein is shown in FIG. 15. Provided is a multiple injector die assembly, generally illustrated as 176. According to this embodiment, a large, one-piece component, such as an instrument panel cross-car beam, may be cast using the hot runner injector arrangement of the present invention.

With reference to FIG. 15, the multiple injector mold assembly 176 includes a manifold 178. The manifold 178 is similar to the manifolds 106 and 136 discussed above in both configuration and function, but differs in that the manifold 178 includes a plurality of injectors in excess of the twin injectors illustrated in the previously-discussed arrangements. Specifically, the manifold 178 of the illustrated embodiment includes a pair of spaced-apart end injectors 180 and 180'. Between the spaced apart end injectors 180 and 180' are intermediate injectors 182, 182', 182" and 182'''. As illustrated the end injectors 180 and 180' are of the same length and the intermediate injectors 182, 182', 182" and 182''' are of the same length. However, it is to be understood that the numbers of injectors and the lengths are only shown herein for illustrative purposes and are not intended as being limiting. A greater or lesser number of injectors having different lengths may be used as well depending on the configuration of the component to be cast.

A manifold inlet 184 is provided on the manifold 178. Molten material is injected into the manifold inlet 184 from the machine nozzle (not shown) in the same manner as discussed above with respect to the use and operation of the machine nozzle 22. The manifold inlet 184 is in fluid communication with a manifold passageway 186. The manifold passageway 186 is in fluid communication with each of the injectors 180, 180', 182, 182', 182" and 182'''.

The multiple injector mold assembly 176 further includes an ejector die half 190 and a cover die half 188. The injectors 180, 180', 182, 182', 182" and 182''' are recessed substantially within the cover die half 188. Between the cover die half 188 and the ejector die half 190 is defined a die cavity 192.

In operation, the molten metal is forced from the machine nozzle (not shown) and into and through the manifold inlet 184, into and through the manifold passageway 186, into and through the injectors 180, 180', 182, 182', 182" and 182''', and into the die cavity 192. The resulting casting (not illustrated) is a highly complex, large, multi-dimensional part. According to the various configurations discussed above, a wide variety of castings having different configurations and sizes may be made according to the teachings of the present invention.

The foregoing discussion discloses and describes an exemplary embodiment of the present invention. One knowledgeable in this area will readily recognize from such discussion, and from the accompanying drawings and claims that various changes, modifications and variations can be made therein without departing from the true spirit and fair scope of the invention as defined by the following claims.

What is claimed is:

1. An apparatus for the casting of metal in a mold cavity defined between a cover die and an ejector die, the apparatus comprising:

a crucible containing a liquid metal, said crucible haying a top;

a shot plunger including an inlet and an outlet and a shut-off including an inlet and an outlet;

a substantially u-shaped supply pipe haying an inlet end and an outlet end, said inlet end being higher than said outlet end whereby said inlet end is closer to said top of said crucible than said outlet end, said inlet of said shut-off being in fluid communication with said outlet end of said pipe and said outlet of said shut-off being in fluid communication with said inlet of said shot plunger;

a hot runner being at least partially recessed within the cover die half, said hot runner having a molten metal passageway formed therethrough, said molten metal passageway of said hot runner having an inlet and an outlet, said inlet of said molten metal passageway being in fluid communication with said outlet of said shot plunger; and a hot runner tip operatively associated with said outlet of said hot runner.

2. The apparatus of claim 1, further including a machine nozzle having a molten metal passageway formed therethrough, said molten metal passageway of said machine nozzle having an inlet and an outlet, said inlet of said machine nozzle being in fluid communication with said outlet of said plunger.

3. The apparatus of claim 1 wherein said shot plunger further includes a piston and a piston cylinder within which said piston is reciprocatingly fitted and wherein said piston is fitted with at least two spaced apart piston rings.

4. The apparatus of claim 3 further including a piston cylinder liner.

5. The apparatus of claim 4 wherein said liner is formed from a ceramic material.

6. The apparatus of claim 1 wherein said shut-off is a check valve.

7. The apparatus of claim 6 wherein said check valve includes a movable check valve ball and a check valve seat.

8. The apparatus of claim 2 further including a heating element fitted to said machine nozzle.

9. The apparatus of claim 8 wherein said heating element is selected from the group consisting of a band heater, a tube heater, and a tubular heater.

10. The apparatus of claim 1 further including a heating element fitted to said hot runner.

11. The apparatus of claim 10 wherein said heating element is selected from the group consisting of a band heater, a tube heater, and a tubular heater.

12. The apparatus of claim 1 further including a heating element fitted to said hot runner tip.

13. The apparatus of claim 12 wherein said heating element is selected from the group consisting of a band heater, a tube heater, and a tubular heater.

14. The apparatus of claim 1 wherein said hot runner includes an inlet port in fluid communication with said outlet of said shot plunger, a manifold passageway in fluid communication with said inlet port, and at least two of said hot runners in fluid communication with said manifold passageway.

15. The apparatus of claim 14 wherein each of said at least two hot runners has a length, said lengths being the same.

16. An apparatus for the casting of metal in a die cavity defined between a cover die and an ejector die, the apparatus comprising:

a crucible containing a liquid metal, said crucible having a top;

a shot plunger including a piston and a piston cylinder, said piston being reciprocatingly fitted within said piston cylinder, said plunger further including a shut-off;

a substantially u-shaped supply pipe having an inlet end and an outlet end, said inlet end being higher than said outlet end whereby said inlet end is closer to said top of said crucible than said outlet end, said shut-off having an outlet in fluid communication with said piston cylinder and an inlet in fluid communication with said outlet end of said pipe, said plunger further including an outlet;

a machine nozzle having a molten metal passageway formed therethrough, said molten metal passageway of said machine nozzle having an inlet and an outlet, said inlet of said machine nozzle being in fluid communication with said outlet of said plunger;

a hot runner being at least partially recessed within the cover die half, said hot runner having a molten metal passageway formed therethrough, said molten metal passageway of said hot runner having an inlet and an outlet, said inlet of said hot runner metal injector being in fluid communication with said outlet of said machine nozzle; and a hot runner tip being fitted to said outlet of said hot runner.

17. The apparatus of claim 16 wherein said piston is fitted with at least two spaced apart piston rings.

18. The apparatus of claim 16 further including a piston cylinder liner.

19. The apparatus of claim 18 wherein said liner is formed from a ceramic material.

20. The apparatus of claim 16 wherein said shut-off is a check valve.

21. The apparatus of claim 20 wherein said check valve includes a movable check valve ball and a check valve seat.

22. The apparatus of claim 16 further including a heating element fitted to said machine nozzle.

23. The apparatus of claim 16 further including a heating element fitted to said hot runner.

24. The apparatus of claim 16 further including a heating element fitted to said hot runner tip.

* * * * *